United States Patent [19]

Haglund

[11] Patent Number: 4,604,754

[45] Date of Patent: Aug. 5, 1986

[54] SUSPENSION DEVICE FOR RESISTOR ELEMENTS IN FURNACES

[75] Inventor: John H. Haglund, Hallstahammar, Sweden

[73] Assignee: Bulten-Kanthal AB, Hallstahammar, Sweden

[21] Appl. No.: 557,288

[22] PCT Filed: Apr. 5, 1983

[86] PCT No.: PCT/SE83/00127

§ 371 Date: Nov. 28, 1983

§ 102(e) Date: Nov. 28, 1983

[87] PCT Pub. No.: WO83/03517

PCT Pub. Date: Oct. 13, 1983

[30] Foreign Application Priority Data

Apr. 2, 1982 [SE] Sweden ..... 8202145

[51] Int. Cl.[4] ..... H05B 3/06

[52] U.S. Cl. ..... 373/130; 373/134

[58] Field of Search ..... 373/128, 130, 134, 137

[56] References Cited

U.S. PATENT DOCUMENTS

| | | | |
|---|---|---|---|
| 1,630,368 | 5/1927 | Woodson | 373/130 |
| 1,645,293 | 10/1927 | Reid | 373/130 |
| 4,154,975 | 5/1979 | Sauder | 373/130 |

*Primary Examiner*—Roy N. Envall, Jr.

*Attorney, Agent, or Firm*—Pollock, Vande Sande & Priddy

[57] ABSTRACT

Suspension device for electric resistor elements (5) in furnaces. A rod element (4) is horizontally arranged and is supported by consoles (2,3) at a distance from the furnace walls (1). The resistor element (5) is suspended on the rod element (4) and forms dense winding coils hanging freely from the rod element substantially in a flattened helical configuration.

11 Claims, 12 Drawing Figures

Fig.10
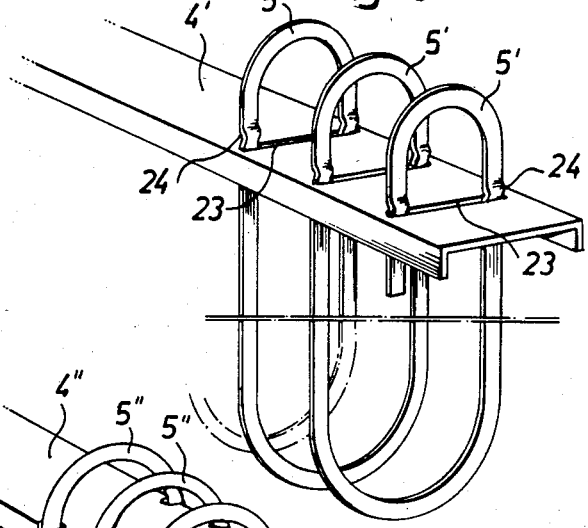
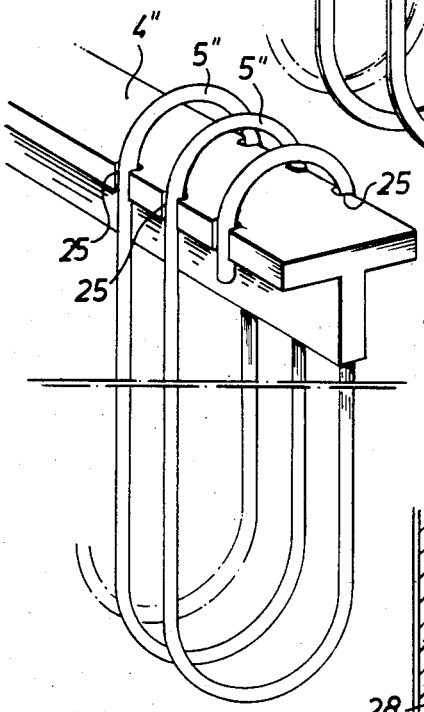
Fig.11
Fig.12
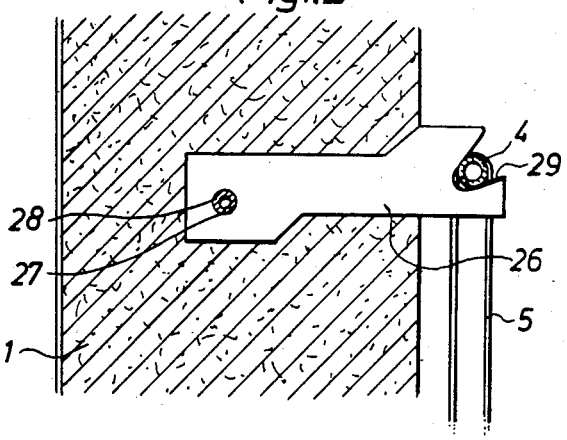

SUSPENSION DEVICE FOR RESISTOR ELEMENTS IN FURNACES

FIELD OF THE INVENTION

The invention relates to a suspension device for loop-shaped resistor elements in furnaces, particularly in furnaces insulated with ceramic fiber materials. Such fiber materials provide important advantages, such as effective insulation, low heat capacity and lower total costs than e.g., bricks. However, the ceramic fiber materials also have certain disadvantages, such as high porosity, low strength and a tendency to crumble.

Various arrangements have previously been suggested on how to mount electrical resistor elements in furnaces insulated with ceramic fiber materials. Thus, U.S. Pat. No. 4,272,638 discloses a device for the suspension of meander-shaped element loops on horizontal ceramic rod elements being fixed to the furnace wall, which consists of fiber material blocks, by means of fasteners holding the rod element against the furnace wall. Along its length, the rod element is provided with grooves or recesses in which the upper end portions of the meander loops are secured. However, the assembly and dismounting of the rod elements are rather complicated.

OBJECT OF THE INVENTION

The object of the invention is to achieve an improved suspension device permitting a high heating power per unit area of the furnace wall and enabling a simple installation and dismounting of the resistor elements, e.g., in connection with repairs of the furnace lining. Another object is to permit the extensive use of standard parts.

SUMMARY OF THE INVENTION

These objects are achieved, according to the invention, in that the supporting means for the substantially horizontal rod element consist of consoles adapted to support the rod element at a distance from the furnace walls and that the resistor element loops form dense winding coils hanging freely from the rod element substantially in a flattened helical configuration. Hereby, one may easily and advantageously use helically wound or bent resistor elements, particularly of a metallic material, and preferably of Fe-Cr-Al alloys (e.g., of the type sold under the registered trade mark KANTHAL), which are resistant in most atmospheres even at temperatures as high as about 1300° C. Owing to the fact that the resistor element loops are supported at the top by the rod element and hang freely therefrom at a distance from the furnace wall, the entire resistor element can easily be dismounted by mere lifting of the rod element with the resistor element supported thereby, e.g., in case the furnace walls need to be repaired or partly replaced. It is hereby a great advantage that the element loops are hanging freely at a distance from the furnace wall, since the resistance material may become rather brittle after a long period of operation and, thus, cannot withstand much mechanical strain or load.

BRIEF DESCRIPTION OF THE DRAWINGS

Further features and advantages of the invention will appear from the detailed description below of several preferred embodiments, reference being made to the appended drawings.

FIGS. 10 and 11 show in perspective views two additional embodiments of the rod element; and FIG. 12 shows in cross section a third embodiment of a console.

DETAILED DESCRIPTION

Figure 1:
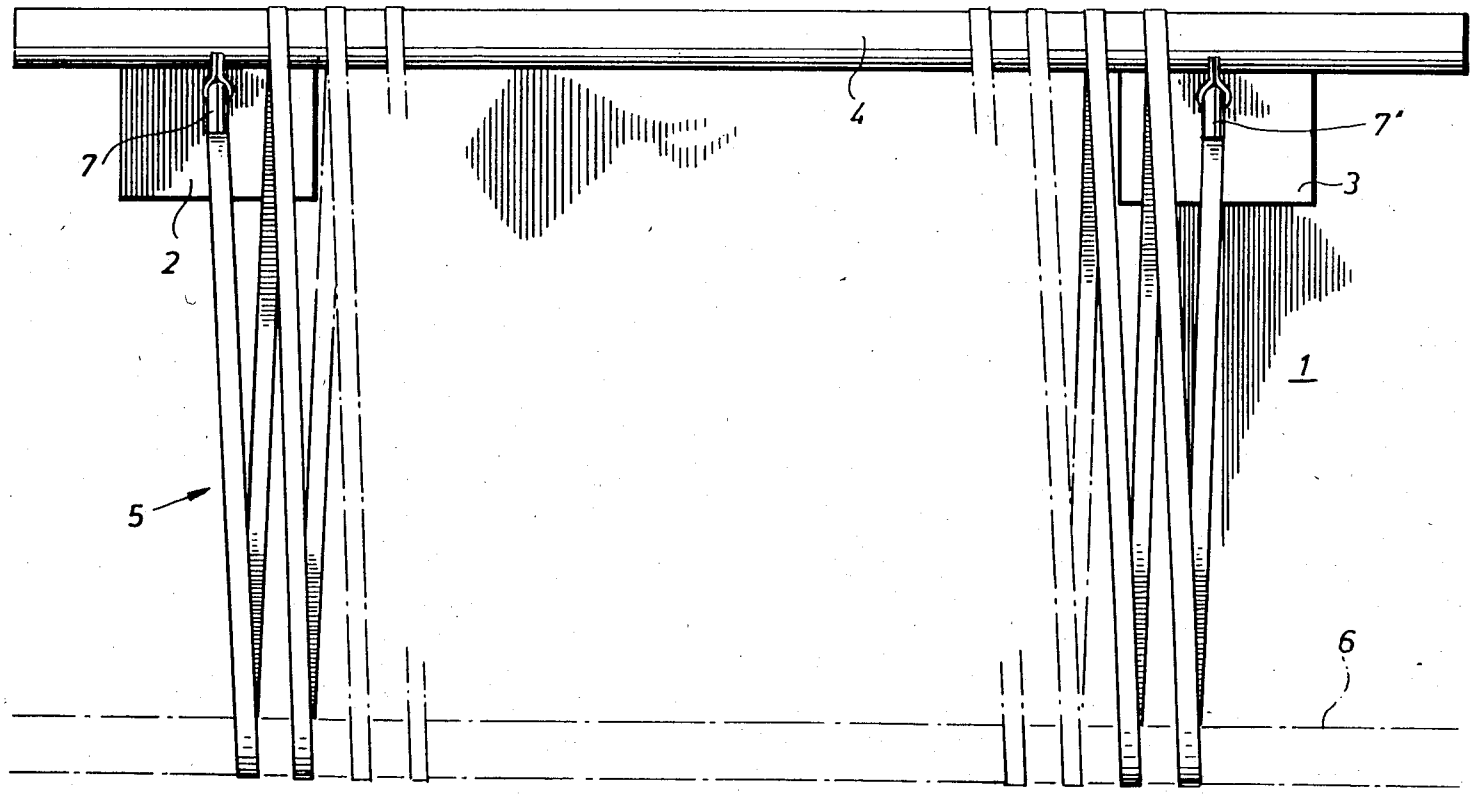
FIG. 1 shows schematically in elevational view a suspension device according to a first embodiment, with consoles arranged adjacent to the terminal portion of the resistor element.

In FIG. 1 a furnace wall 1 is schematically shown, said wall being assumed to consist essentially of an insulating, ceramic fiber material, wherein consoles 2 and 3 are mounted at the furnace wall 1 and support a substantially horizontally oriented rod element 4 in the form of a ceramic tube. On the rod element 4 a loop-shaped resistor element 5 is suspended. The resistor element consists of a metallic material, namely a Fe-Cr-Al alloy of the type sold under the trade mark KANTHAL, having the shape of a flat band being wound into a helix and thereafter suspended in a flattened configuration from the rod element 4, so that each winding coil hangs freely from the rod element, preferably at a distance downwards corresponding to at least five times the diameter of the rod element, so that the resistor element loops together rather densely cover a relatively large surface area somewhat inside the furnace wall 1. In practice, the hanging loops can reach downwards about 200 to 1000 mm. However, when the operational temperature of the resistor elements is high, e.g., 1100°–1300° C., the downwardly extension should not exceed about 500 mm (due to the self-dilatation under the influence of gravity). As indicated by dashed lines, a guiding rod 6 could possibly be arranged to guide the lower portions of winding coils. If desired, the guiding rod could be provided with recesses or means to maintain the winding coils at a uniform distance from each other.

Figure 2:
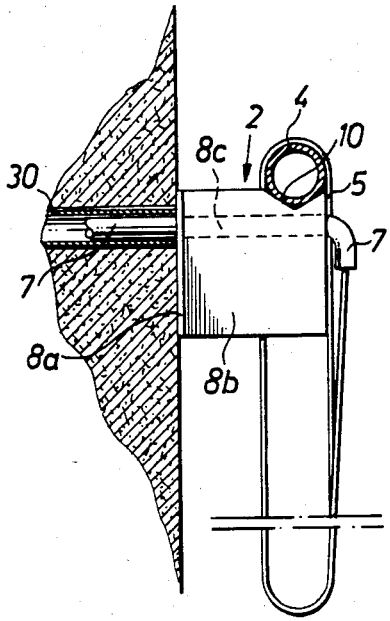
FIG. 2 shows the device according to FIG. 1 from one end thereof.

In accordance with the invention, the rod element 4 is supported at a distance from the furnace wall 1 by means of the consoles 2 and 3. In this case, the consoles are located adjacent to the terminal portions 7, 7' of the element 5. FIG. 2 shows how the terminal portion 7 extends inside a lead-through means in the form of a ceramic tube 30 through the furnace wall 1 and into the furnace through the console 2. For this purpose, the latter is constituted by two bent plate members 8,9, preferably also of a Fe-Cr-Al alloy, each such member having a leg 8*a* and 9*a*, respectively, abutting flat against the furnace wall 1, and a leg 8*b* and 9*b*, respectively, extending perpendicularly thereto. Each leg 8*b*, 9*b* is provided with a substantially semi-cylindrically bent portion 8*c* and 9*c*, respectively, which are connected to each other, e.g., by welding, while enclosing the terminal portion 7', within the complementary portions 8c, 9c. Hereby, the entire console 2 will be supported by the terminal portion 7', and no separate fasteners between the respective console 2, 3 and the furnace wall 1 are therefore needed. Adjacent to the outer, free end portions of the legs 8b and 9b, respectively, a recess 10 is provided in their upper edges. The recess 10 has an upward V-shape and is dimensioned to form a bearing surface for the tubular rod element 4, so that the latter rests in a well defined position at a distance from the furnace wall 1. This distance should correspond to at least one tube diameter (for the tube 4), so that the loop portions of the element 5 located closest to the furnace wall hang freely inside the furnace wall 1. When dismounting the resistor element 5, the consoles 2,3 are pulled straight out from the inside of the furnace wall 1 (upon disconnecting the terminal portions at the outside of the furnace wall 1), so that both the terminal portions 7,7', the rod element 4 as well as the resistor element 5 supported thereby will follow along as one unit. In this way, damage to the element loops is avoided and the element can be used again, e.g., after reconstruction or repair of the furnace lining.

At temperatures where the plate material gets deformed e.g., above 1000° C., it may be desirable to make the consoles 2, 3 entirely or partly of a ceramic material, e.g., Sillimanit or Mullit.

Figure 3:
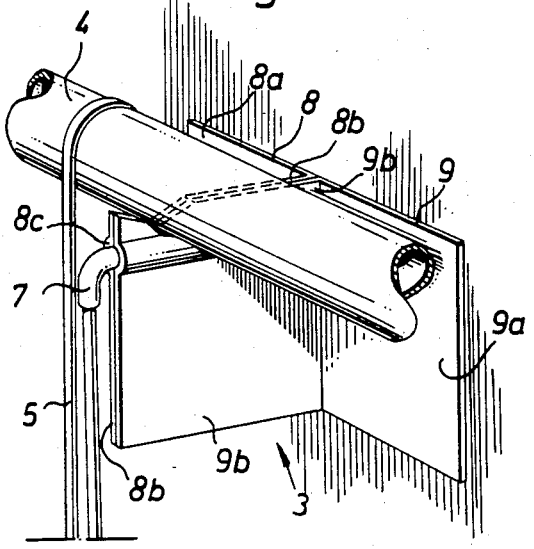
FIG. 3 shows in a perspective view one of the consoles of the device according to FIG. 1.
Figure 4:
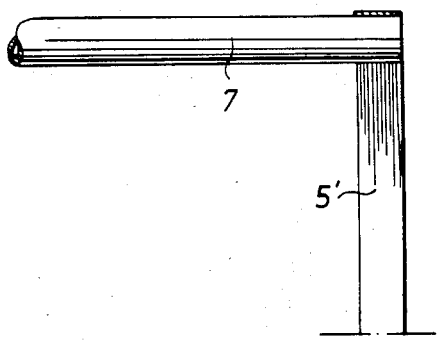
FIGS. 4 and 5 show schematically in elevational views the joint between the terminal portion and the resistor element for flat elements bent edgeways and round resistor elements, respectively.
Figure 5:
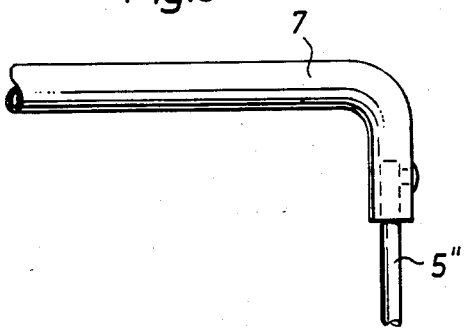

The embodiment according to FIGS. 1 to 3 with consoles resting on the terminal portions of the resistor element is also very advantageous in existing furnaces with linings of brick material since, only through holes need to be made, and specific fasteners are not needed. In FIGS. 1 to 3 the resistor element 5 is made from a flat-wound band. As possible alternatives hereto, FIGS. 4 and 5 show a part of a likewise flat band 5' (FIG. 4) wound or bent edgeways and a wire 5'' of circular cross section (FIG. 5), respectively, wherein in both cases only the connection to the terminal portion 7 is shown.

Figure 6:
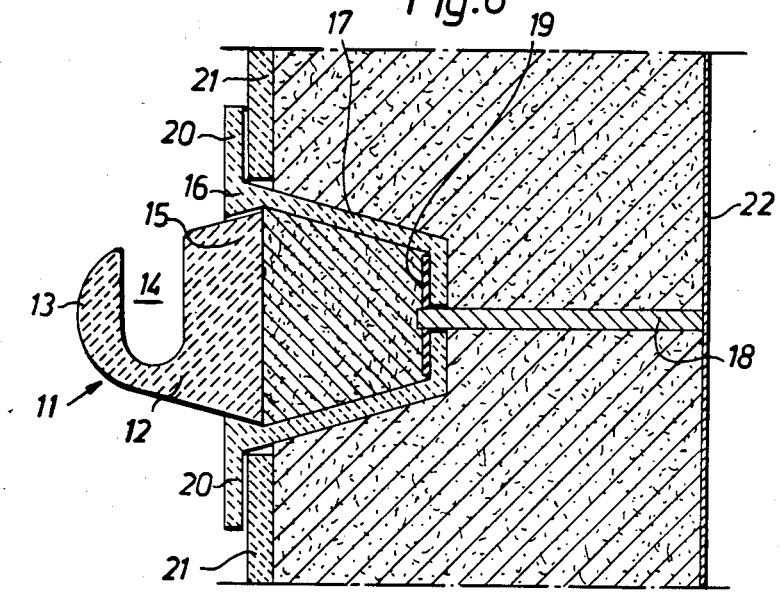
FIG. 6 shows a cross section of a console according to a second embodiment.
Figure 7:
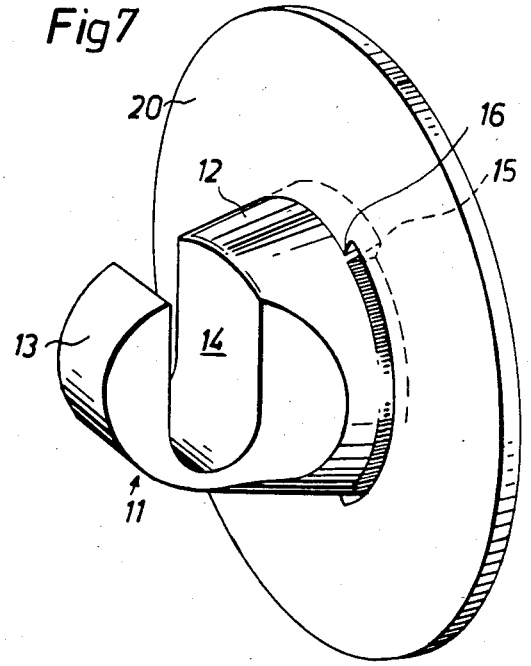
FIG. 7 shows the console according to FIG. 6 in a perspective view.

FIGS. 6 and 7 show an alternative embodiment of the consoles supporting the rod element 4, here generally denoted by the numeral 11. The consoles 11 are separately arranged in relation to the terminal portions 7, the lead-through tube 30 and each console 11 thus being located at some distance from each other in the longitudinal direction of the rod element. The console 11 consists of a ceramic body having a substantially circular base portion 12 and an outer portion 13 shaped as a hook, said portion 13 forming a hook opening 14 for supporting the rod element 4. Even in this case, the hook opening 14 is located at a distance of at least one diameter of tube 4 from the inside of the furnace wall 1, so that the loops of the resistor element 5 hang freely downwards from the rod element. The hook body 11 is detachably coupled by means of bayonet coupling members 15, 16, to holder 17, in the form of a bowl or a pot, anchored to the furnace wall 1, the bottom of the holder being secured by a metallic pin 18 having a metal washer 19 and the edge portion thereof being formed as a circumferential flange 20. This flange 20 abuts and holds a ceramic disc 21 located at the inside of the furnace wall 1. The pin 18 extends through a hole in the bottom of the pot, and the disc 19, being screwed thereon as a nut or secured by welding, anchors the pot 17, the ceramic disc 21 and the hook body 13, the other end of the pin 18 being fixed to the outer plate mantle 22 of the furnace wall 1 in a suitable manner. Between said outer plate mantle 22 and the inner ceramic disc 21 as well as inside the pot 17, a ceramic fiber material is disposed for heat insulation of the furnace wall. The hook body 11, the pot 17 and the ceramic disc 21 may be made of a suitable refractory material, e.g., Sillimanit or Mullit.

The hook body 11 also serves as a lid to the pot 17 and contributes to the temperature reduction of the metallic anchoring means 18,19. The hook body can easily be detached from the holder pot 17 by rotation of, e.g., 90°, so that the bayonet coupling members 15,16 are freed. It is preferable to turn the pot 17, so that the hook body can maintain its position and support the rod element 4.

Figure 8:
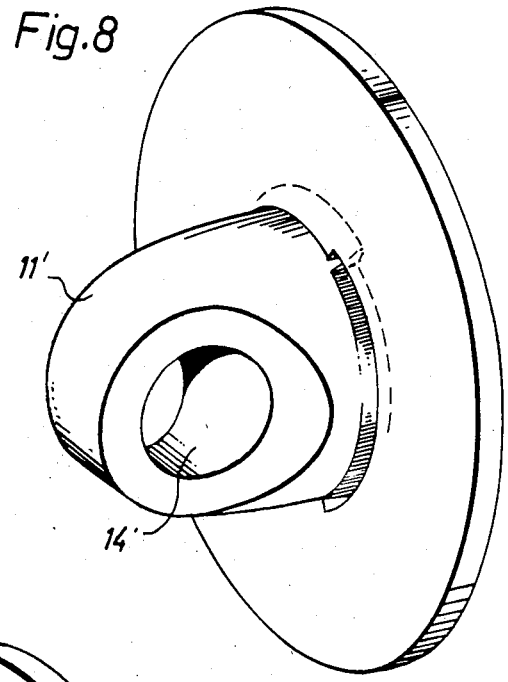
FIGS. 8 and 9 show two modifications of the console according to FIGS. 6 and 7.
Figure 9:
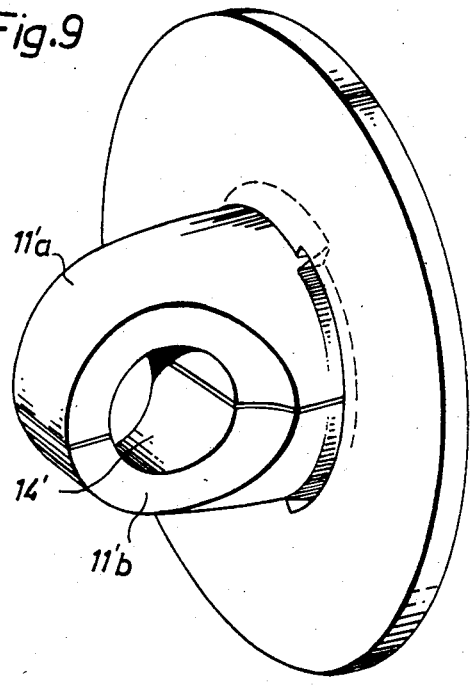

Instead of a hook body, the modification shown in FIG. 8 is provided with an eye body 11' with a through-hole 14' for the rod element. In this case, it is necessary that the eye body maintain its position when dismounting, e.g., by turning the pot 17 in the manner mentioned above. As appears from FIG. 9, the eye body 11' can also be divided into two halves 11'a and 11'b, whereby the mounting is further facilitated. When the eye body is divided, it can be provided with recesses for the terminal portions of the resistor elements, which terminal portions then can be combined with the anchoring pin 18 (FIG. 6).

FIGS. 10 and 11 show modified embodimemts of the rod element 4 in the form of a reserved U-profile (FIG. 10) and a T-profile (FIG. 11), respectively, of a ceramic material. The supporting means of the consoles (not shown) are of course adjusted to each profile, respectively, so that the rod element is fixed at a desired distance from the furnace wall.

The profile member 4' according to FIG. 10 is in the central web portion provided with transversal slot 23 in the region of each element loop, which in this case consists of a flat band 5' bent edgeways (compare FIG. 4). Upon introducing the upper portions of the loops from underneath through the slots 23 (the width of which only slightly exceeds the band thickness), the band loops are bent somewhat sideways, as shown at 24, so that the bent out band portions 24 rest on the top side of the profile member 4' adjacent each respective slot 23.

In FIG. 11, the T-shaped profile member 4'' is provided with recesses 25 on the longitudinal edges of the horizontal profile leg for securing each resistor element loop 5''. In this case the resistor element consists of a helically wound wire having a circular cross section (compare FIG. 5).

FIG. 12, finally, shows an example of a fixedly arranged console 26 consisting of a ceramic body, which is mounted already when manufacturing the furnace wall blocks by vacuum forming of a ceramic fiber material. For additional anchorage and positioning of each console 26, a tube 27 is inserted through a hole 28 in the inner end portion of the console and is embedded into the wall insulation as well as, if necessary, connected to one or several additional consoles 26. At its free end portion located inside the furnace wall 1, the console 26 has a hook opening 29 facing obliquely inwards/upwards towards the interior of the furnace, into which opening 29 a rod element 4 can be inserted and suspended together with a corresponding resistor element 5. In this case as well, the terminal portions 7 are led through separate openings (not shown) in the furnace wall.

The rod element as well as the consoles and the other parts can be modified in different ways within the scope of the invention. For example, the consoles can be adapted to be secured to the ceiling of the furnace. The essential idea is to provide for substantially horizontal suspension of the rod element 4 in the consoles, so that the resistor element loops hang freely at a distance from the furnace wall substantially in a flattened helical configuration.

I claim:

1. Suspension device for loop-shaped electrical resistor elements (5, 5', 5'') having loops in a furnace having a wall, comprising a rod element (4;4', 4'') resting substantially horizontally on consoles (2, 3; 11; 26) which support said loops in closely located winding coils substantially in a flattened helical configuration, wherein the terminal portion (7) of the resistor element are located adjacent to the rod element (4,4', 4'') and the consoles (2, 3; 11; 26) also serve as spacer elements for suspension of the resistor element coils, so that the latter hang freely from the rod element (4,4',4'') at a distance from the furnace wall (1) and cover a relatively large surface area thereof, the rod element (4,4',4'') and the suspended resistor element (5,5',5'') being removable as a unit from the furnace.

2. Suspension device according to claim 1, wherein the resistor element coils reach downwards a distance corresponding to at least five times the diameter of the rod element.

3. Suspension device according to claim 1 or 2, wherein the rod element (4';4'') has recesses (23, 25) distributed along its longitudinal direction for securing each winding coil.

4. Suspension device according to claim 3 wherein said recesses are constituted by through-going slots (23) in the rod element (4'), the upper portion of each winding coil of the resistor element (5') extending through such a slot and being deformed (24) sideways relative thereto.

5. Suspension device according to claim 1, wherein at least one console (2,3) is located adjacent to a wall opening (30) for the terminal portion (7) of the resistor element.

6. Suspension device according to claim 5, wherein each console (2,3) is supported by a terminal portion (7) of the resistor element.

7. Suspension device according to claim 5, wherein the console (2,3) and the rod element (4) supported thereby, together with the corresponding resistor element (5) and terminal portion (7), are removable from the furnace wall (1) as a unit.

8. Suspension device according to claim 5, wherein the console (3) comprises a flat portion (8*a*, 9*a*) abutting the furnace wall and a holder portion (8*b*,9*b*) resting on the element terminal portion (7), which holder portion in its turn supports the rod element (4).

9. Suspension device according to claim 8, wherein the console (3) consists of at least one bent plate (8,9), and wherein said holder portion at least partly (8*c*,9*c*) encloses the terminal portion.

10. Suspension device according to claim 1, wherein the consoles consist of ceramic bodies (11) which are positively connectable to holding members (17, 18, 19) anchored in the furnace wall or the furnace ceiling.

11. Suspension device according to claim 10, wherein the ceramic bodies and the holding means are provided with mutually cooperating bayonet coupling members (15, 16).

* * * * *